United States Patent [19]

Seragnoli

[11] 4,441,662

[45] Apr. 10, 1984

[54] REELS SUPPLYING DEVICE

[75] Inventor: Enzo Seragnoli, Bologna, Italy

[73] Assignee: G. D. Societa' per Azioni, Bologna, Italy

[21] Appl. No.: 345,039

[22] Filed: Feb. 2, 1982

[30] Foreign Application Priority Data

Feb. 25, 1981 [IT] Italy ..... 3344 A/81

[51] Int. Cl.[3] ..... B65H 19/08; B65H 17/02

[52] U.S. Cl. ..... 242/58; 242/58.6; 242/68.3; 414/276

[58] Field of Search ..... 242/58, 58.1, 58.2, 242/58.6, 180, 181, 68, 68.3; 414/267, 268, 276, 278

[56] References Cited

U.S. PATENT DOCUMENTS

| | | | |
|---|---|---|---|
| 3,750,804 | 8/1973 | Lemelson | 414/276 |
| 3,920,195 | 11/1975 | Sills et al. | 242/180 |
| 4,084,762 | 4/1978 | Repp | 242/68.3 |

*Primary Examiner*—Leonard D. Christian

*Attorney, Agent, or Firm*—Merriam, Marshall & Bicknell

[57] ABSTRACT

A device for automatically supplying reels to a utilizer machine, in which a support element for a reel is movable between the output of a reel magazine and an unwinding spindle disposed on the utilizer machine and is provided with actuator means which is operable to actuate locking means carried by the unwinding spindle, by contact therewith, to lock each reel in succession thereon.

6 Claims, 2 Drawing Figures

REELS SUPPLYING DEVICE

BACKGROUND OF THE INVENTION

The present invention relates to a device for automatically supplying reels to an operating machine. In particular, the present invention relates to a device particularly adapted to be used for supplying reels of paper to a cigarette-making machine, but which is advantageously usuable on any other type of operating machine which uses web material which can be wound into reels.

In the above mentioned operating machine, and in particular, in cigarette-making machines, which latter will be discussed below by way of example only and without loss of generality, the strip of paper forming the outer casing of the cigarettes is drawn from a reel which, given the high productive capacity of the said cigarette-making machines, is used up in a relatively short time and must be replaced relatively often with a new reel. The replacement operation mentioned above can, if effected by hand, be heavy and difficult for the operators who have to perform it; consequently, several proposals have been made for performing this operation automatically.

For example, a first known reel supply device has a reel, disposed in a working or unwinding position keyed to a vertical spindle, the said unwinding spindle, above which there is a stack of horizontal reserve reels which are coaxial therewith.

In the known supply device described above, the replacement of an empty reel with a new reel takes place in an automatic manner by means of axially sliding the lower reel of the said stack and coupling it with the said unwinding spindle.

The known supply device described above has a number of disadvantages the main one of which is constituted by the fact that the reserve reels, being disposed coaxial to the said unwinding spindle and above this, constitute an overall encumbrance which reduces drastically the accessibility of the lower members of the supply device itself.

In the second place, the known supply device described above normally requires the use of an auxiliary deflector unit, seeing that the web is disposed on edge at the output, with respect to a horizontal plane, and must normally be turned through 90° before it can be used.

A further known supply device includes a supply of reels in which the reels are disposed on edge alongside one another on a horizontal conveyor.

The reels are taken up individually and in succession from the said supply by means of a pusher, the action of which makes each reel roll along an inclined plane at the lower end of which each reel is stopped in a position coaxial to a support pin.

This latter, by displacing axially, engages the said reel and conveys it to an unwinding position.

A solution of this type elininates the disadvantages of the first known supply device described above in that it allows a reserve of reels to be gathered at a convenient distance from the unwinding position, that is to say in a position in which they do not in any way limit the accessability to the members of the supply device itself. However, this other known supply device described above is not free from disadvantages in that the path of the reels along the said inclined plane is substantially uncontrolled.

SUMMARY OF THE INVENTION

The object of the present invention is that of providing a supply device which will be free from the above mentioned disadvantages.

The said object is achieved by the present invention in that it relates to a device for automatically supplying reels to a utiliser machine, the device comprising a magazine for a plurality of reserve reels disposed in a position adjacent the said machine, an unwinding spindle disposed on the said machine, and transfer means for successively transferring the said reels from the said magazine to the said spindle; characterised by the fact that the said transfer means include a support element for one said reel, which is movable between a take-up position in front of the said magazine and a release position in front of the said spindle, the said magazine including an inclined conveyor along which the said reels are able to advance in contact with one another and parallel to their axes, stop means for releasably stopping one said reel in the said take-up position; and locking means carried by the said unwinding spindle, actuable by the said support element for successively locking each said reel on the said unwinding spindle.

BRIEF DESCRIPTION OF THE DRAWINGS

Further characteristics and advantages of the present invention will become apparent from the following description with reference to the attached drawings, which illustrates a non-limitative embodiment thereof, in which.

DETAILED DESCRIPTION OF THE INVENTION

Figure 1:
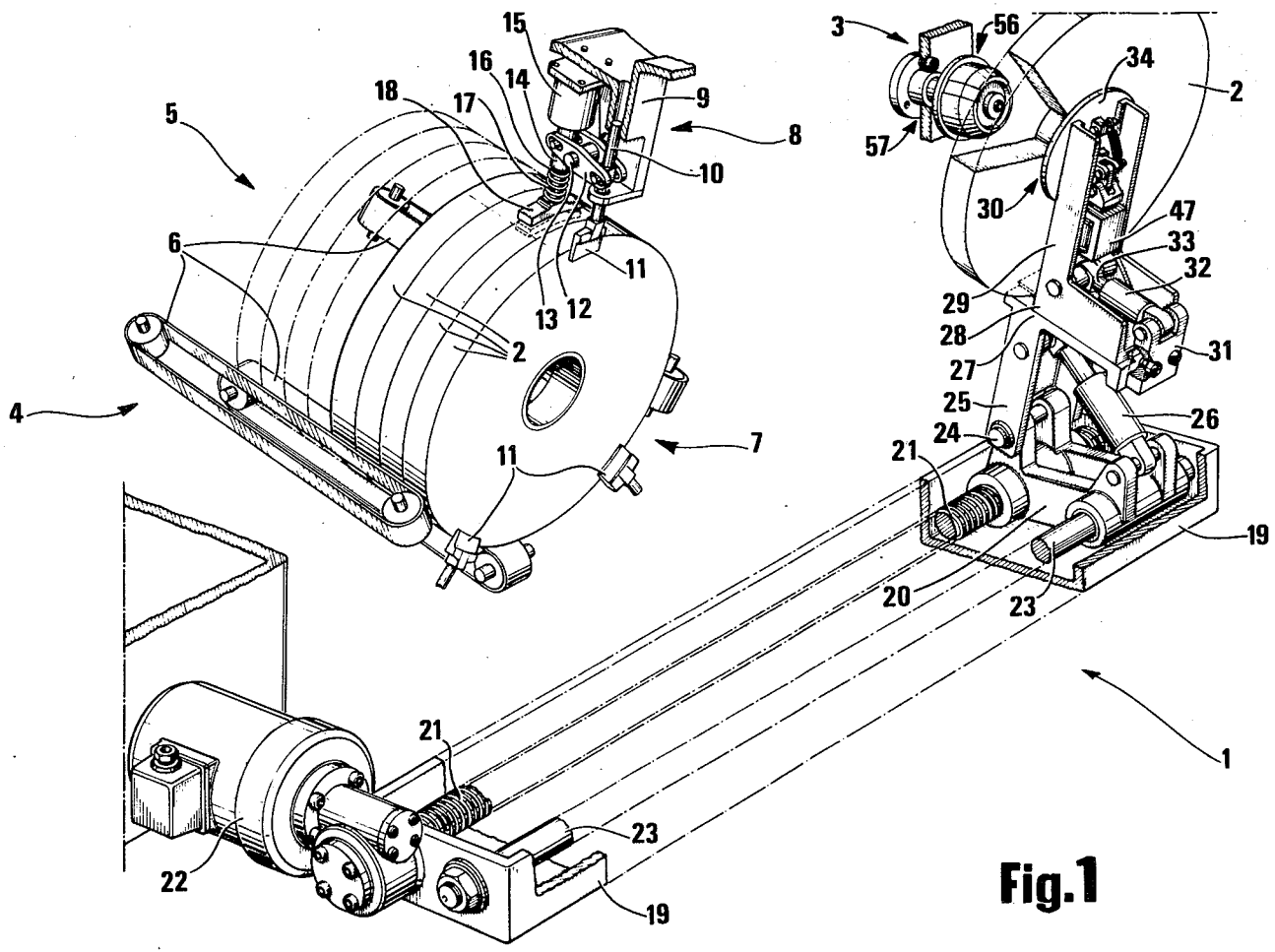
FIG. 1 is a schematic perspective view of a reel supply device formed according to the principles of the present invention.

In FIG. 1 there is illustrated a device 1 for automatically supplying reels of paper 2 to a utiliser machine 3, in particular to a cigarette-making machine.

The device 1 includes a magazine 4 for reserve reels 2 disposed with their edges in contact with one another on an inclined conveyor 5.

This latter is defined, in the illustrated example, by three conveyor belts 6 parallel to one another and inclined downwardly, which are disposed in such a way as to define a "cradle" which can prevent the reels 2 from rolling in a direction perpendicular to that of the conveyors 6. These latter can be operated step-wise to convey the reels 2 towards a take-up station 7 at the lowermost end of the conveyors 6.

The magazine 4 is provided, at its lower end, with a stop device 8 arranged above the conveyors 6 and including a fixed bracket 9 on which is slidably mounted a rod 10 extending radially downwardly with respect to the reels 2 and carrying connected to its lowermost end, a stop element 11. This latter is movable, together with the rod 10, between a lowered stop position in which the element 11 is disposed in the path followed by the reels 2 during their movement along the inclined plane 5 and is operable to cooperate frontally with the first of the reels 2 in order to stop it in the take-up position 7, and a raised, rest position in which the stop element 11 is located out of the said path and cannot interfere with the reels 2.

At an intermediate point along the rod 10 there is pivoted a first end of a rocker 12 which is pivoted at 13 on the bracket 9 and is pivoted at the other end to an output arm 14 of a linear actuator 15 which can be constituted by an hydraulic or pneumatic cylinder or else by an electric solenoid. The rod 14 is disposed parallel to the rod 10 above the second reel 2 when the first of the reels 2 is disposed in the take-up position 7. The arm 14 is coupled telescopically, with the interposition of a spring 16, to a second rod 17 to the lower free end of which is connected a stop block 18. The latter is movable between a lower operating position (indicated with broken lines) in which it acts to cooperate radially with the said second reel 2 to lock it in contact with the conveyors 6, and a raised rest position.

As illustrated in FIG. 1, there are provided two further stop elements 11 (which could be omitted) disposed beneath the reels 2 between the conveyors 6 and operated by the upper stop element 11 by means of a transmission, not illustrated. Beneath the lower end of the magazine 4 and in a position adjacent thereto is disposed an elongated box 19 the axis of which extends substantially horizontally and in a direction perpendicular to the axis of the magazine 4. Within the box 19 there is movably mounted a carriage 20 the movement of which is controlled by a screw 21 extending axially along the box 19 and driven by a reversible motor 22. The carriage 20 is, moreover, coupled slideably to a rod 23 extending within the casing 19 parallel to the screw 21.

At the end of the carriage 20 opposite the magazine 4 there is pivoted, at 24, the lower end of a forked lever 25 movable on the carriage 20 towards and away from the magazine 4 under the thrust of linear actuator 26 the operation of which causes a rotation of the lever 25 about the pivot 24 between a substantially vertical position and a position inclined perpendicularly with respect to the axis of the magazine 4. At the other end of the lever 25 there is connected a guide 27 disposed perpendicularly to the lever 25 and above the carriage 20. The guide 27 extends perpendicularly to the axis of the rod 23 and slidably supports a slide 28 from the end facing the magazine 4 of which there extends an upright 29 parallel to the lever 25 and carrying connected to its upper end a support element 30 for a reel 2. From the end of the guide 27 opposite that carrying the upright 29 there extends upwardly a bracket 31 to which is anchored a linear actuator 32 an output arm 33 of which is connected to the upright 29 for imparting to and fro movements to the support element 30, in a direction perpendicular to the lever 25 and the rod 23.

Figure 2:
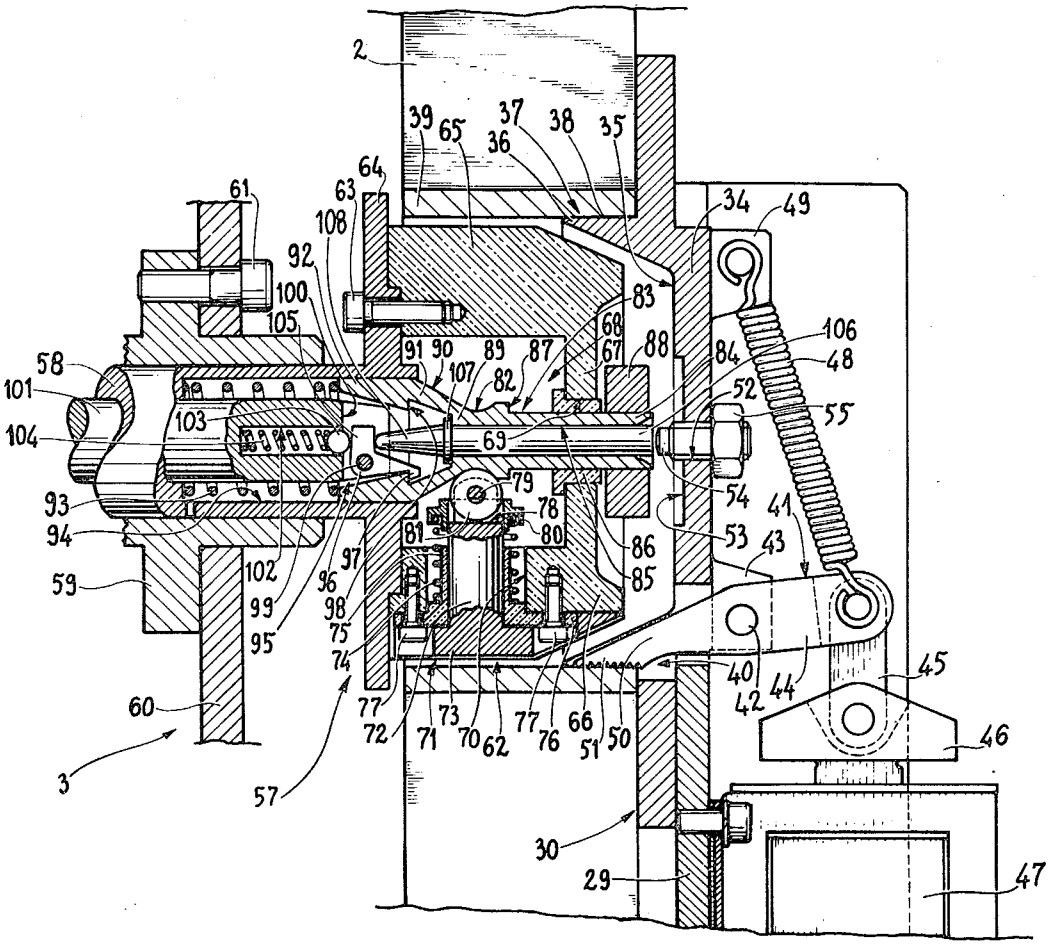
FIG. 2 illustrates a detail of FIG. 1 in section and on an enlarged scale.

As illustrated, in particular in FIG. 2, the element 30 includes a circular plate 34 rigidly connected to the upright 29. The plate 34 has a flat surface 35 facing the magazine 4 and provided with an annular rib 36 defining a sleeve 37 which can engage with its outer cylindrical surface 38 an end portion of the inner surface of a tubular hub 39 of a reel 2. Through the plate 34 and the rib 36 there is formed a slit 40 within which is mounted a rocker 41 pivoted at 42 onto a first projection 43 extending from the surface of the plate 34 opposite the surface 35. The rocker 41 has a first arm 44 connected on one side, by means of a link 45 to the free end of an out-put arm 46 of a linear actuator 47 carried by the upright 29 and on the other side, by means of a tension spring 48 to a second projection 49 carried by the surface of the plate 34 opposite the surface 35 in a position diametrically opposite the projection 43.

The rocker 41 is moreover provided with a second arm 50 terminating in a toothed jaw 51 which, under the tension of the spring 48, tends normally to project outwardly from the surface 38 of the sleeve 37.

The plate 34 has a threaded central through hole 52 formed in the bottom of a cylindrical recess 53 coaxial with the rib 36 and formed on the surface of the plate 34 facing towards the magazine 4. Through the hole 52 there is mounted a threaded stud 54 the tip of which faces the magazine 4 and is locked in a selected position by means of a nut 55 mounted on the stud 54 in contact with the plate 34.

The carriage 20 can be displaced by the screw 21 along the rod 23 between the said take-up position 7 and a release position 56 (FIG. 1) in which the carriage 20 is located opposite an unwinding spindle generally indicated 57 of the utiliser machine 3.

As illustrated in FIG. 2 the spindle 57 includes a hollow shaft 58 extending rotatably through a tubular support 59 mounted through a hole formed in a wall 60 of the machine 3 and fixed to this latter by means of screws 61. The spindle 57 includes, moreover, a reel-carrier head 62 connected by screws 63 to a central portion of an end flange 64 of the shaft 58 constituted by a cup-like body 65 a lateral cylindrical wall 66 of which has an outer diameter less than the inner diameter of the hub 39 and is closed outwardly by a bottom wall 67 and at the inner end by the flange 64 in such a way as to define an internal chamber 68 which communicates with the outside via an axial through hole 69 formed through the wall 67.

Through the wall 66 there are formed three radial holes 70 (only one of which is illustrated) uniformly distributed about the cup-like body 65 and each housing a locking device generally indicated 71 and comprising a radial piston 72 provided at an outer end with a block 73 and outwardly sidable, against the thrust of a helical spring 74 within a tubular element 75.

This latter is mounted through a respective hole 70 and is provided with an outer flange 76 fixed to the wall 66 by screws 77. On the inner end of each piston 72 there is formed a diametrical groove 78 through which extends a pin 79. This latter serves the double function of axially locking an annular cap 80 for axially containing the associated springs 74, and of supporting a roller 81 normally located with a part of its outer periphery in contact with the bottom surface of an annular groove 82 formed on a tubular body 83 coaxial with the shaft 58. The tubular body 83 includes a tubular shaft 84 which has an axial hole 85 with an inner diameter greater than the diameter of the stud 54 and is mounted through the hole 69 with the interposition of an anti-friction bush 86 for sliding through the wall 67 between an extended position, in which an annular shoulder 87 at the end of the shaft 84 is located in contact with the inner end of the bush 86, and a retracted position in which the outer end of the bush 86 abuts against a small cylindrical plate 88 having a smaller diameter than that of the cavity 53 and fixed to a portion of the shaft 84 projecting out from the cup-like body 65. The shaft 84 is rigidly connected to a bottom wall 89 of a cup-like body 90 located with its concavity facibng the shaft 58 and having a lateral wall comprising a frusto-conical wall 91 connected to the wall 89 and a cylindrical wall 92 connected to the larger base of the wall 91 and slidably engaged, against the action of a spring 93, within an axial hole 94 formed on the shaft 58 and communicating with the chamber 68.

The tubular body 83 is normally maintained with the shaft 84 in the retracted position by means of a releasable hook device generally indicated 95 and including a bell crank 96 a first arm of which is provided with a tooth 97 which can hook onto an annular tooth 98 formed on the inner surface of the cup-like body 90. The bell crank 96 is rotatably supported by a pivot 99 passing through a diametral slot 100 in a fixed cylindrical core 101 extending within the hole 94 and through the spring 93. The core 101 has an axial hole 102 which opens out onto the bottom of the slot 100 and slidably houses a ball 103.

This latter is thrust outwardly by a spring 104 and cooperates with a second arm 105 of the bell crank 96 to maintain the tooth 96 in the hooked position.

The hooking device 95 includes a release element constituted by a shaft 106 slidably mounted within the hole 85 of the shaft 84. The shaft 106 has an annular flange 107 which is disposed in contact with the inner surface of the bottom wall 89 of the cup-like body 90 when the outer end of the shaft 106 is substantially flush with the outer end of the shaft 84. Within the cup-like body 90 the shaft 85 terminates with a conical tip 108 aligned with the spring 104 and the ball 103 and cooperating with a surface of the arm 105 of the bell crank 96 opposite that cooperating with the ball 103.

In use, the carriage 20 is located at the take-up station 7 by operation of the motor 22 and the screw 21. Before reaching the take-up position 7 the guide 28 is displaced towards the bracket 31 by operation of the actuator 32, and the lever 25 is inclined by operation of the actuator 26 in such a way as to dispose it in a position perpendicular to the axis of the magazine 4.

When the carriage 20 has reached the take-up position 7 the actuator 32 is operated in such a way as to press the support element 30 towards the first of the reels 2 in the magazine 4 until the sleeve 37 is engaged within the tubular hub 39 thereof.

Simultaneously with engagement of the sleeve 37 within the hub 39 there occurs operation both of the actuator 47, which causes the jaw 51 to project out and lock the hub 39 onto the sleeve 37, and of the actuator 15 which causes displacement of the stop elements 11 to their rest position and displacement of the block 18 into contact with the periphery of the second reel 2. The first reel 2 is then withdrawn from the magazine 4 by retraction of the support element 30 and the associated slide 29, whilst the actuator 15 is carried back to the initial position causing, in the first place, the return of the stop elements 11 to their operating position and, subsequently, the raising of the block 18 which releases the reels 2 to advance by one step under the thrust of the conveyors 6.

The reel 2 taken from the magazine 4 is conveyed to the release position 56 by the displacement of the carriage 20 towards the unwinding spindle 57 and the rotation of the lever 95 towards the vertical position.

During the normal operating stages of the machine 3 the reel mounted on the unwinding spindle 57 is locked angularly and axially with respect to the cup-like body 65 by the action of the pistons 72 and the associated blocks 73 which are thrust outwardly by the spring 93. This latter in fact, acts on the end of the tubular body 83 which, being normally disengaged from the tooth 97, slides outwardly until it stops, if not otherwise engaged, with its shoulder 87 in contact with the inner end of the bush 86. In practice, the stroke of the tubular body 83 is stopped before this because the progressive outward sliding of the cup-like body 90 carries the frusto-conical wall 91 thereof to cooperate with the rollers 81 of the piston 72 which stop in contact with the inner surface of the hub 39 and consequently cause the tubular body 83 to stop before the shoulder 87 thereof comes into contact with the bush 86.

When the reel 2 mounted on the unwinding spindle 57 is empty, an operator causes a thrust opposite that of the spring 93 to be applied from the outside onto the tubular body 83 in such a way as to make the body 83 retract until the tooth 97 snaps into engagement with the annular tooth 98 in such a way as to retain the body 83 in the retracted position illustrated in FIG. 2.

The retraction of the tubular body 83 involves a simultaneous retraction of the pistons 72 the blocks 73 of which become spaced from the inner surfaces of the hub 39 which can be removed from the unwinding spindle 57 manually or else by means of an automatic expelling device not illustrated.

At this point the new reel has already been carried into the release position 56 by means of the carriage 20 and can be fitted onto the unwinding spindle 57 simply by operating the actuator 32 in such a way as to displace the slide 28 towards the cup body 65 which is located coaxially with the hub of the reel 2 carried by the support element 30. As shown in FIG. 2, in which the support element 30 and the unwinding spindle 57 are illustrated in an operating position immediately before the release of the new reel 2 from the element 30 and the locking of this onto the head 62, the operation of the actuator 32 carries the stud 54 to engage the outer end of the shaft 106 which is thrust inwardly of the hole 85 against the action of the spring 104 causing a rotation of the bell crank 96 about the pivot 99 and the disengagement of the tooth 97 from the tooth 98. The tubular body 83, freed from the tooth 97, is now free to snap outwardly under the thrust of the spring 93 in such a way as to cause the pistons 72 to project outwardly and lock the new hub 39 on the reel carrier head 62.

The subsequent operation of the actuator 47 against the action of the spring 48 causes retraction of the jaw 51 into the sleeve 37 and the consequent dis-engagement of the support element 30 from the reel 2. Retraction of the slide 28 and displacement of the carriage 20 towards the take-up station 7 puts the supply device 1 in the initial condition for performing a new operating cycle.

What is claimed is:

1. A device for automatically supplying reels (2) to a user machine (3), the device comprising a magazine (4) for a plurality of reserve reels (2) each provided with an internal tubular support tube (39), an unwinding spindle (57) arranged on said machine (3), a support member (20, 30) for one of said reels (2), and first releasable locking means (71) carried by said spindle (57) and adapted to be operated by the support member (20, 30) for locking said one reel (2) on the spindle (57), said support member (20, 30) being mounted for movement between a take-up position (7) in front of said magazine (4) and a release position (56) in front of said spindle (57) and comprising second releasable locking means (51) adapted to engage an inner surface of the hub (39) of said one reel (2) to lock the same relative to said support member (20, 30), and actuator means (47) associated with said second locking means (51) to move the same radially of said hub (39) to a locking position.

2. A device for automatically supplying reels (2) to a user machine (3), the device comprising a magazine (4) for a plurality of reserve reels (2) each provided with an internal tubular support hub (39), an unwinding spindle (57) arranged on said machine (3), the spindle (57) having a shaft (58) and a reel carrier head (62) rigidly connected to said shaft (58), said reel carrier head (62) having an apertured cup-shaped body (65), a support member (20, 30) for one of said reels (2), and first releasable locking means (71) carried by the spindle (57) and extending in a substantially radial direction through the cup-shaped body (65), the locking means (71) being adapted to be operated by the support member (20, 30) for locking one reel (2) on the spindle (57), said support member (20, 30) being mounted for movement between a take-up position (7) in front of said magazine (4) and a release position (56) in front of said spindle (57) and comprising second releasable locking means (51) adapted to engage an inner surface of the hub (39) of said one reel (2) to lock the same relative to said support member (20, 30), and actuator means (47) associated with said second locking means (51) to move the same radially of said hub (39) to a locking position.

3. A device as claimed in claim 2, wherein said support member (20, 30) further comprises a cylindrical sleeve (37) adapted to engage part of the inner surface of the hub (39) of a reel (2), an axial slit (40) being provided on said sleeve (37), and the second locking means comprises a jaw (51) extending through the slit (40) and movable relative to said sleeve (37) in a substantially radial direction under thrust from the actuator means (47).

4. A device as claimed in claim 2, wherein said first locking means (71) comprises a plurality of pistons (72) radially mounted on said cup-shaped body (65), wege means (91) is slidably coupled with an inner end of a piston (72), and resilient means (93) cooperates with the wedge means (91) to move the same axially of said cup-shaped body (65), hook means (95) retains said wedge means (91) against the thrust of the resilient means (93), and a release means (106) operable by the support member (20, 30) disengages the hook means (95) from the wedge means (91).

5. A device as claimed in claim 4, wherein an axial tooth (97) is provided on the wedge means (91), the hook means (95) comprises a movable bell crank (96) having a first arm and a second arm, a tooth (97) extends laterally from the first arm and is adapted to hook the axial tooth (97), resilient means (104) urges the bell crank (96) to a hooking position, the release means includes a shaft (106) mounted for axial movement through the cup-shaped body (65) and is adapted to engage the second arm of the bell crank (96) to turn the same against the action of said further resilient means (104), and the support member (20, 30) has an axial stud (54) adapted to displace the shaft (106) axially.

6. A device as claimed in claim 1, wherein said support member (20, 30) further comprises a cylindrical sleeve (37) adapted to engage part of the inner surface of the hub (39) of a reel (2), an axial slit (40) being provided on said sleeve (37), and the second locking means comprises a jaw (51) extending through the slit (40) and movable relative to said sleeve (37) in a substantially radial direction under thrust from the actuator means (47).

* * * * *